US011181295B2

(12) United States Patent
Wang et al.

(10) Patent No.: US 11,181,295 B2
(45) Date of Patent: Nov. 23, 2021

(54) INDOOR UNIT OF AIR CONDITIONER AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Xiansong Wang, Guangdong (CN); Qiang Qin, Guangdong (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 41 days.

(21) Appl. No.: 16/818,193

(22) Filed: Mar. 13, 2020

(65) Prior Publication Data

US 2020/0208870 A1 Jul. 2, 2020

Related U.S. Application Data

(63) Continuation of application No. PCT/CN2018/075281, filed on Feb. 5, 2018.

(30) Foreign Application Priority Data

Sep. 21, 2017 (CN) ..... 201710870214.8

(51) Int. Cl.
*F24F 13/02* (2006.01)
*F24F 1/0057* (2019.01)
(Continued)

(52) U.S. Cl.
CPC ..... *F24F 13/0254* (2013.01); *F24F 1/0057* (2019.02); *F24F 13/0245* (2013.01); *F24F 13/32* (2013.01); *F24F 1/0314* (2019.02)

(58) Field of Classification Search
CPC ..... F24F 1/0314; F24F 13/32; F24F 13/0254; F24F 1/02; F24F 1/0007; F24F 1/0057; F24F 13/0245
See application file for complete search history.

(56) References Cited

U.S. PATENT DOCUMENTS 3,878,856 A * 4/1975 Hall ..... A47L 15/30 134/60
2015/0267938 A1 9/2015 Cho et al.

FOREIGN PATENT DOCUMENTS

CN 1502944 A * 6/2004
CN 102261700 A 11/2011
(Continued)

OTHER PUBLICATIONS

Jin, CN 1502944A English machine translation, Jun. 9, 2004 (Year: 2004).*

(Continued)

*Primary Examiner* — Kenneth J Hansen
*Assistant Examiner* — Phillip Decker
(74) *Attorney, Agent, or Firm* — Scully Scott Murphy & Presser

(57) ABSTRACT

An indoor unit of an air conditioner and an air conditioner are provided. A bracket of the indoor unit has a chassis. The chassis has a limiting structure. An air duct assembly of the indoor unit is detachably engaged or magnetically connected with an upper portion of the chassis. A movable limiting member of the indoor unit is provided to the air duct assembly. The movable limiting member is configured to movably protrude from the air duct assembly and engage with the limiting structure to retain the air duct assembly within the bracket.

14 Claims, 12 Drawing Sheets

(51) Int. Cl.
*F24F 13/32* (2006.01)
*F24F 1/0314* (2019.01)

(56) References Cited

FOREIGN PATENT DOCUMENTS

| | | | |
|---|---|---|---|
| CN | 105928078 | A | 9/2016 |
| CN | 106016468 | A | 10/2016 |
| CN | 205878343 | U | 1/2017 |
| CN | 107036173 | A | 8/2017 |
| CN | 107062389 | A | 8/2017 |
| CN | 107143924 | A | 9/2017 |
| CN | 206478740 | U | 9/2017 |
| CN | 107588519 | A | 1/2018 |
| CN | 207299419 | U | 5/2018 |
| JP | S55-116034 | A | 9/1980 |
| JP | H07-042967 | A | 2/1995 |
| JP | H08-135994 | A | 5/1996 |
| JP | H10-141693 | A | 5/1998 |
| JP | H11-083110 | A | 3/1999 |
| JP | 2011-043253 | A | 3/2011 |
| JP | 2014-215024 | A | 11/2014 |
| KR | 100813325 | B1 | 3/2008 |

OTHER PUBLICATIONS

Notice of Reasons for Refusal dated Mar. 30, 2021 received in Japanese Patent Application No. JP 2020-511257 together with an English language translation.
Notification of Reason for Refusal dated Mar. 30, 2021 received in Korean Patent Application No. KR 10-2020-7005504 together with an English language translation.
Supplementary European Search Report dated Jul. 20, 2020 received in European Patent Application No. EP 18857934.6.
International Search Report and Written Opinion dated Jun. 7, 2018 received in International Patent Application No. PCT/CN2018/075281 together with an English language translation.

* cited by examiner

INDOOR UNIT OF AIR CONDITIONER AND AIR CONDITIONER

FIELD

The present disclosure relates to the field of air conditioning products, and in particular, to an indoor unit of an air conditioner and an air conditioner.

BACKGROUND

At present, household air conditioners become more and more popular, consumers are paying more and more attention to the health and sanitary conditions during the use of the household air conditioners. Deep cleaning of the air duct system is an important practice for ensuring good health and sanitary conditions of air conditioner use. During use, the indoor air is blown back to the room after going through the filter, the heat exchanger, the wind wheel and theair duct, respectively. Thus, if the above parts are not cleaned in a timely manner, the dust can bel adhered to the condensed water and the water vapor in the air, so that bacteria and even mildew are likely to be bred in the parts, and the air blown by the air conditioner will be polluted during use.

The related art provides an indoor unit of an air conditioner. An upper portion of the air duct assembly is detachably connected to the chassis, and a lower portion of the air duct assembly is fixed to the chassis by screws, so that the user can normally disassemble and assemble the air duct assembly for cleaning. However, in view of the compact structure of the internal cavity of the indoor unit of the air conditioner, the cumbersome disassembly-assembly methods of screw locking has affected the disassembly-assembly efficiency of the air duct assembly to a certain extent, thereby reducing the convenience of cleaning or maintenance of the air duct assembly.

SUMMARY

The main object of the present disclosure is to provide an indoor unit of an air conditioner, which aims to solve the technical problem of the inconvenience of cleaning or maintenance of the air duct assembly of the indoor unit of the air conditioner since the lower portion of the air duct assembly is fixed with screws in the related art.

To achieve the above object, the present disclosure provides an indoor unit of an air conditioner, including:

a bracket, including:

a chassis, including:

a limiting structure;

an air duct assembly, located in front of the chassis, and detachably engaged or magnetically connected with the chassis; and a movable limiting member, provided to the air duct assembly, where the movable limiting member is configured to movably protrude from the air duct assembly and engage with the limiting structure to limit the air duct assembly inside the bracket.

For example, the movable limiting member is pivotally connected to the lower portion of the air duct assembly in the left-right direction to rotate back and forth relative to the air duct assembly.

For example, the movable limiting member is a first rotating buckle, the first rotating buckle including:

a first buckle body, pivotally connected to the lower portion of the air duct assembly in the left-right direction; and a first buckle portion, located at an end of the first buckle body adjacent to the chassis; and, where:

the limiting structure is a buckle slot adapted to fit the first buckle portion.

For example, the lower portion of the air duct assembly includes:

a first mounting slot, penetrating through a wall of the air duct assembly in a front-rear direction, the first rotating buckle being partially provided in the first mounting slot, a side wall of the first mounting slot including a first shaft hole in the left-right direction; and the first buckle body includes:

a first rotating shaft, matched with the first shaft hole, and inserted in the first shaft hole.

For example, the first mounting slot includes two side walls, each side wall including a guiding slot extending rearward and obliquely from a front edge of the each side wall, a tail end of each guiding slot including one first shaft hole.

For example, the indoor unit of the air conditioner further includes:

an elastic protrusion, protruded downwardly from a top wall of the first mounting slot;

an abutting rib, protruded from an upper surface of the first buckle body, and including:

a first limiting slot, recessed on the abutting rib and facing the elastic protrusion; and a second limiting slot, recessed on the abutting rib and facing the elastic protrusion; and, where:

the first limiting slot is located in front of the second limiting slot; and, where:

the elastic protrusion movably abut against the abutting rib;

the elastic protrusion is limited by the first limiting slot to keep the first buckle portion being engaged with the buckling slot; and the elastic protrusion is limited by the second limiting slot to keep the first buckle portion being away from the buckle slot.

For example, the indoor unit of the air conditioner further includes:

a first protrusion portion, protruded from an upper side of the abutting rib; and a second protrusion portion, protruded from the upper side of the abutting rib; and, where:

the first protrusion portion and the second protrusion portion are spaced apart in the front-rear direction, the first protrusion portion being located in front of the second protrusion portion; and the first limiting slot is defined between the first protrusion portion and the second protrusion portion, the second limiting slot being defined at a rear side of the second protrusion portion.

For example, the bracket further includes:

a face frame, located in front of the air duct assembly, a front side of the air duct assembly being movably engaged with the surface frame.

For example, a bottom of a water receiving tray in front of the air duct assembly includes:

an engaging portion; and the surface frame includes:

a second rotating buckle, adapted to fit the engaging portion, and pivotally connected to the face frame in the left-right direction to rotatably engage with the engaging portion.

For example, the second rotating buckle includes:

a second buckle body, one end of the second buckle body being pivotally connected to the face frame in the left-right direction; and a second buckle portion, located on a surface of the second buckle body facing the air duct assembly, and disposed away from a pivot end of the second buckle body.

For example, the face frame includes:

a second mounting slot, penetrating through a wall of the face frame in the front-rear direction, a side wall of the second mounting slot including a second shaft hole in the left-right direction; and the second buckle body includes:

a second rotating shaft, matched with the second shaft hole, and inserted in the second shaft hole.

For example, the indoor unit of the air conditioner further including:

two limiting protrusions, disposed oppositely with each other, each limiting protrusion being protruded from an edge at a side of a slot opening of the second mounting slot; and, where:

the two second limiting protrusions are located in front of the second buckle body when the second buckle portion is buckled or snap-fitted with the engaging portion.

For example, the indoor unit of the air conditioner further includes:

elastic engaging buckles, provided at an upper portion of the chassis in the left-right direction;

engaging structures, provided at a rear edge of an upper portion of the air duct assembly in the left-right direction; and, where:

the elastic engaging buckles are detachably engaged with the engaging structures.

For example, the bracket further includes:

two fixing portions, one fixing portion being protruded from a left end of a front side of the chassis, the other fixing portion being protruded from a right end of the front side of the chassis, each fixing portion including:

a first sliding portion, provided on an opposite lateral side of each fixing portion; and the air duct assembly includes:

two second sliding portions, one second sliding portion being provided on a left end of the air duct assembly, the other second sliding portion being provided on a right end of the air duct assembly; and where:

each first sliding portion and each corresponding second sliding portion are slidably matched in a up-down direction of the chassis.

The present disclosure further provides an air conditioner, which includes an outdoor unit and an indoor unit. The indoor unit of the air conditioner includes:

a bracket, including:

a chassis, including:

a limiting structure;

an air duct assembly, located in front of the chassis, and detachably engaged or magnetically connected with the chassis; and a movable limiting member, provided to the air duct assembly, where the movable limiting member is configured to movably protrude from the air duct assembly and engage with the limiting structure to limit the air duct assembly inside the bracket.

For example, the movable limiting member is pivotally connected to the lower portion of the air duct assembly in the left-right direction to rotate back and forth relative to the air duct assembly.

For example, the movable limiting member is a first rotating buckle, the first rotating buckle including:

a first buckle body, pivotally connected to the lower portion of the air duct assembly in the left-right direction; and a first buckle portion, located at an end of the first buckle body adjacent to the chassis; and, where:

the limiting structure is a buckle slot adapted to fit the first buckle portion.

For example, the lower portion of the air duct assembly includes:

a first mounting slot, penetrating through a wall of the air duct assembly in a front-rear direction, the first rotating buckle being partially provided in the first mounting slot, a side wall of the first mounting slot including a first shaft hole in the left-right direction; and the first buckle body includes:

a first rotating shaft, matched with the first shaft hole, and inserted in the first shaft hole.

For example, the bracket further includes:

a face frame, located in front of the air duct assembly, a front side of the air duct assembly being movably engaged with the surface frame.

For example, a bottom of a water receiving tray in front of the air duct assembly includes:

an engaging portion; and the surface frame includes:

a second rotating buckle, adapted to fit the engaging portion, and pivotally connected to the face frame in the left-right direction to rotatably engage with the engaging portion.

According to the technical solution of the present disclosure, a limiting structure is arranged at a lower portion of a chassis of the indoor unit of the air conditioner, and a movable limiting member is arranged at a lower portion of an air duct assembly, where the movable limiting member is configured to movably protrude from the air duct assembly and engage with the limiting structure. It can be understood that, compared with the related art that the lower portion of the air duct assembly is fixed with screws, this arrangement simplifies the disassembly process of the air duct assembly, thereby effectively improving the convenience of maintenance or cleaning of the air duct assembly.

BRIEF DESCRIPTION OF THE DRAWINGS

In order to explain the technical solutions in the embodiments of the present application or the prior art more clearly, the drawings used in the description of the embodiments or the prior art will be briefly introduced below. Obviously, the drawings in the following description are merely some embodiments of the present application. For those of ordinary skill in the art, other drawings can be obtained based on the structure shown in these drawings without creative labor.

DESCRIPTION OF THE REFERENCE NUMERALS

TABLE 1

Figure 1:
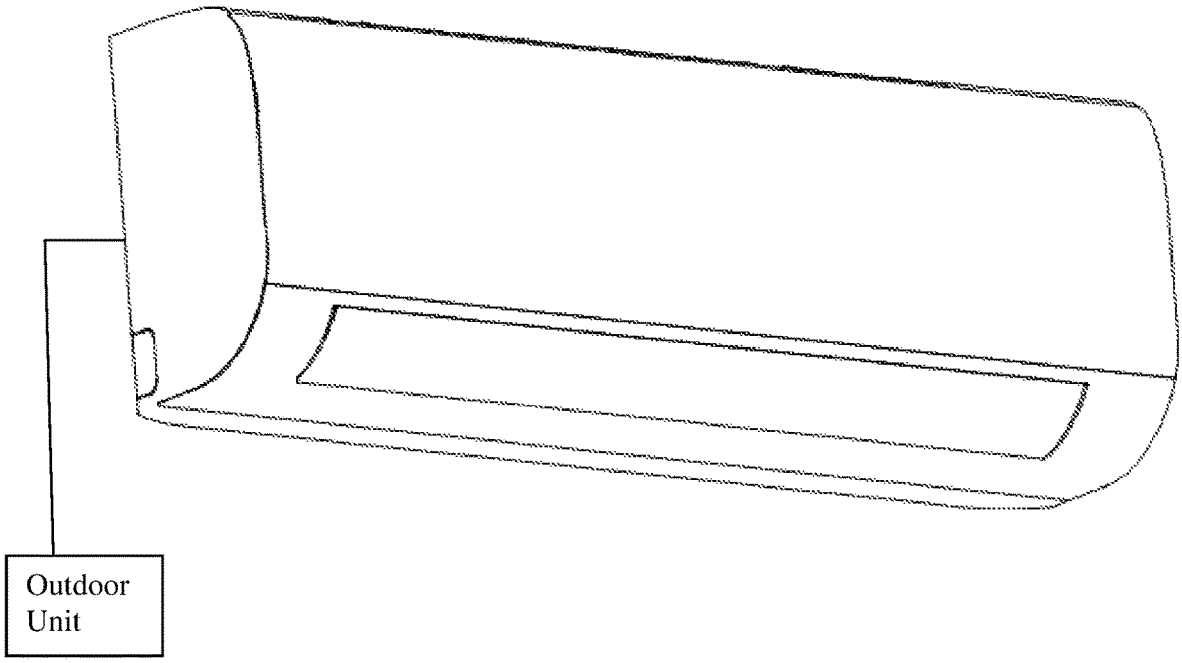
FIG. 1 is a schematic structural view of an indoor unit of an air conditioner according to an embodiment of the present disclosure.
Figure 2:
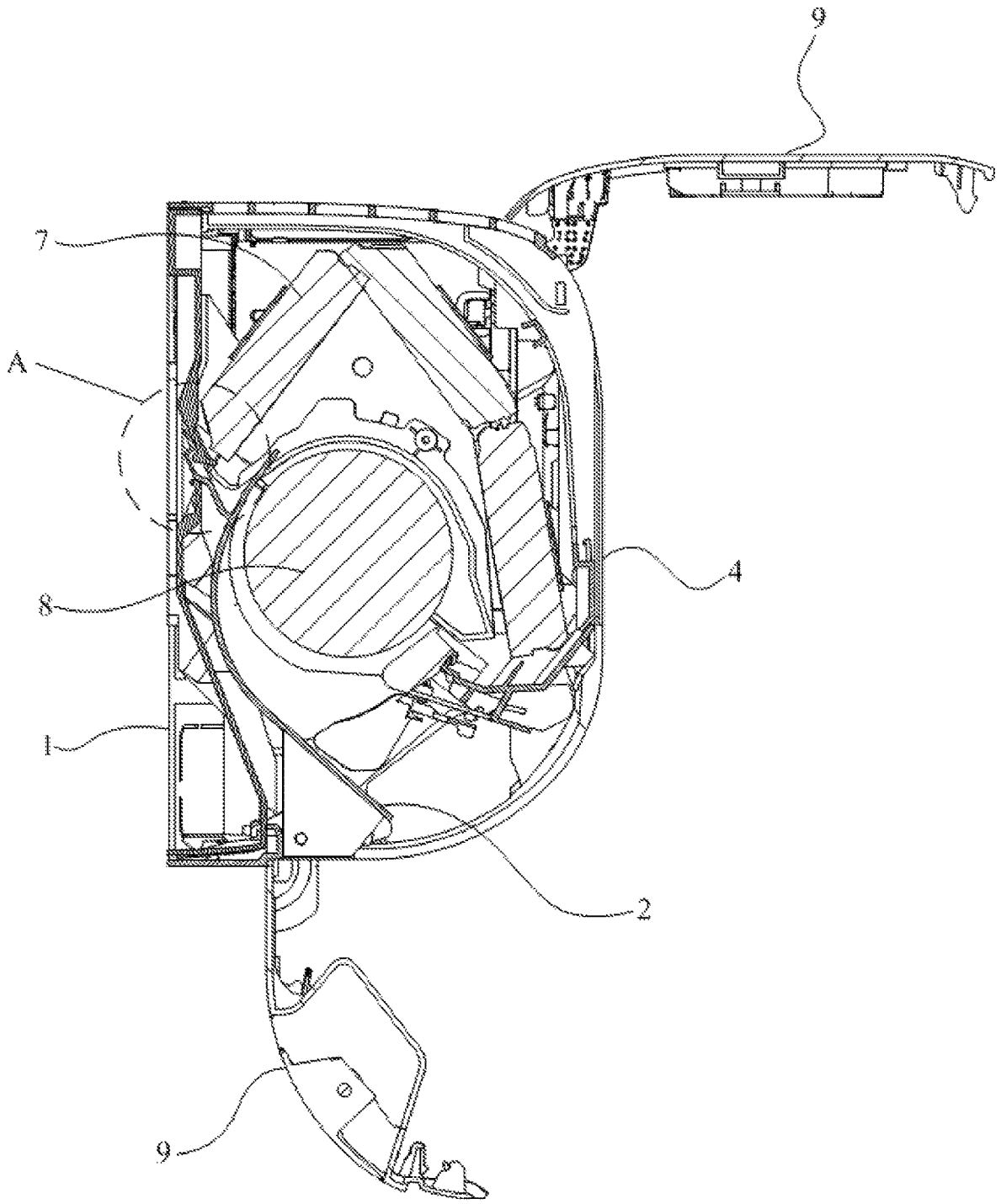
FIG. 2 is a schematic cross-sectional view of the indoor unit of the air conditioner in FIG. 1.
Figure 3:
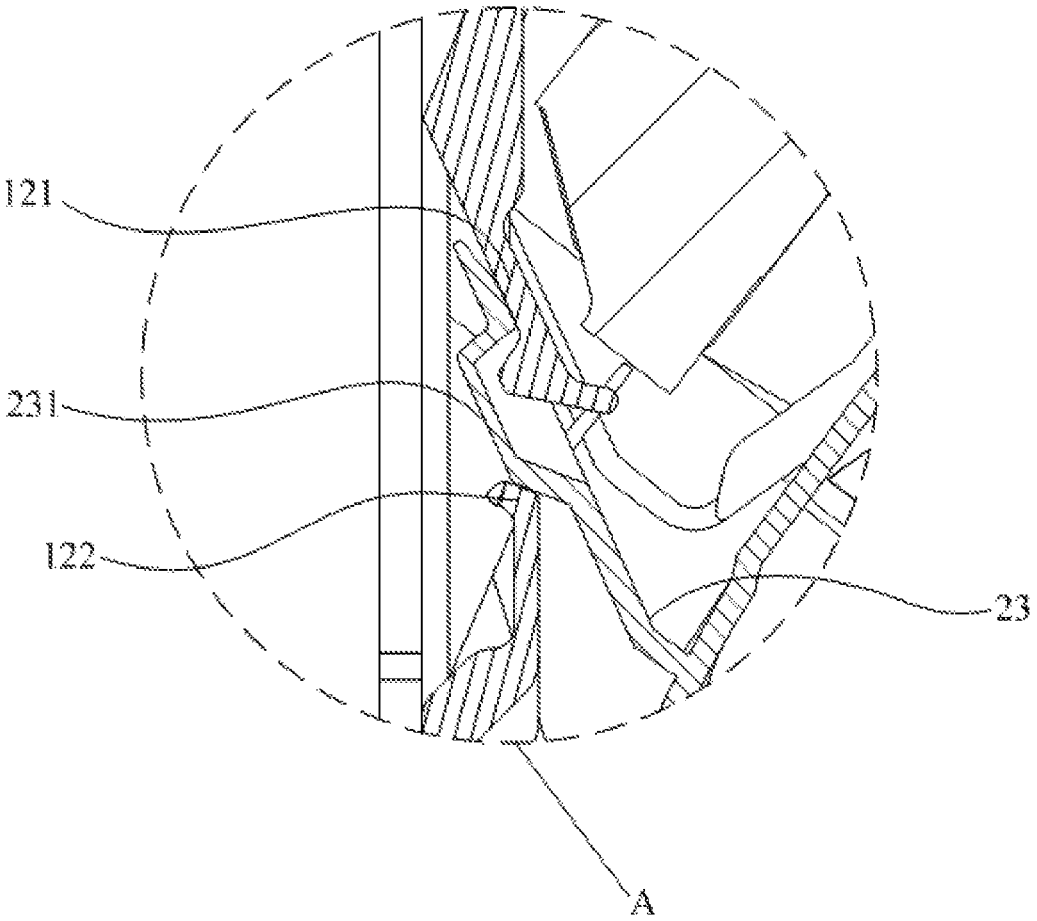
FIG. 3 is a schematic enlarged view of a portion A in FIG. 2.

| Reference numeral | Name | Reference numeral | Name |
|---|---|---|---|
| 1 | Chassis | 11 | Buckle slot |
| 12 | Elastic engaging buckle | 121 | Upper elastic buckle |
| 122 | Lower elastic buckle | 123 | Guiding block |
| 2 | Air duct assembly | 21 | First mounting slot |
| 211 | First shaft hole | 212 | Elastic protrusion |
| 213 | Guiding slot | 22 | Front water receiving tray |
| 221 | Engaging portion | 23 | Rear water receiving tray |
| 231 | Engaging slot | 24 | Sliding shaft |
| 3 | First rotating buckle | 31 | First buckle body |
| 32 | First buckle portion | 33 | First rotating shaft |
| 34 | Abutting rib | 341 | First limiting slot |
| 342 | Second limiting slot | 343 | First protrusion portion |
| 344 | Second protrusion portion | 4 | Face frame |
| 41 | Second mounting slot | 411 | Second shaft hole |
| 412 | Limiting protrusion | 5 | Second rotating buckle |
| 51 | Second buckle body | 52 | Second buckle portion |
| 53 | Second rotating shaft | 54 | Abutting block |
| 6 | Fixing portion | 61 | Guiding rail |
| 7 | Heat exchanger | 8 | Cross flow wind wheel |
| 9 | Panel | | |

The implementation, functional features and advantages of the present application will be further described with reference to the accompanying drawings.

DETAILED DESCRIPTION OF THE EMBODIMENTS

The technical solutions in the embodiments of the present application are clearly and completely described in the following with reference to the drawings in the embodiments of the present application. It is obvious that the described embodiments are only a part of the embodiments of the present application, and not all of them. All other embodiments obtained by those of ordinary skill in the art based on the embodiments of the present application without creative labor are within the scope of the present application.

It should be noted that all directional indications (such as up, down, left, right, front, back, . . . ) in the embodiments of the present application are only used to explain the relative position relation, motion, etc. of each component under a certain posture (as shown in the drawing). If the specific posture changes, the directional indication also changes accordingly.

In addition, the descriptions of "first", "second", and the like in the present application are used for descriptive purposes only, and are not to be construed as indicating or implying their relative importance or implicitly indicating the number of technical features indicated. Thus, features defining "first" or "second" may include at least one of the features, either explicitly or implicitly. In addition, the technical solutions of the various embodiments may be combined with each other, but must be based on the realization of those skilled in the art, and when the combination of the technical solutions is contradictory or impossible to implement, it should be considered that the combination of the technical solutions does not exist, nor is it within the scope of protection required by the present application.

The present disclosure provides an indoor unit of an air conditioner.

In some embodiments of the present disclosure, referring to FIGS. 1 to 9, the indoor unit of the air conditioner includes a bracket (not shown). The bracketincludes a chassis 1, and a limiting structure is provided at a lower portion of the chassis 1. The bracket defines a rear (or posterior) side of the air conditioner, through which the air conditioner can be mounted to an outside support, which can be for example a wall of a household. The air conditioner has a front (or anterior) side, which is distanced from the outside support but opposite to the rear (or posterior) side of the air conditioner.

The indoor unit further includes an air duct assembly 2, located in front of the chassis 1, and an upper portion of the air duct assembly 2 is detachably connected (for example, through mechanical, electrical, or magnetic engagement, coupling or connection) with an upper portion of the chassis 1.

The indoor unit also includes a movable limiting member, provided to a lower portion of the air duct assembly 2, where the movable limiting member is configured to movably protrude in a front-rear direction from a rear side of the air duct assembly and to snap fit or engage with a corresponding limiting structure to limit the air duct assembly 2 inside the bracket.

In this embodiment, the bracket further includes a face frame 4 located in front of the air duct assembly 2. A panel 9 of the indoor unit of the air conditioner is installed outside the face frame 4. Structures such as a heat exchanger 7 and a cross flow wind wheel 8 are provided between the face frame 4 and the chassis 1.

For example, when disassembling the air duct assembly 2, after opening the panel 9, the movable limiting member is adjusted in the front-rear direction to separate it from the limiting structure, and the air duct assembly 2 is subsequently pulled down with a certain force (increasing force). When the pull-down force is greater than the connecting force (such as, the engaging force or magnetic attraction force) of the upper portion of the air duct assembly 2 and the chassis 1, the upper portion of the air duct assembly 2 is also separated from the chassis 1, so that the air duct assembly 2 is detached from the bracket.

According to the present disclosure, the limiting structure is arranged at the lower portion of the chassis 1 of the indoor unit of the air conditioner, and the movable limiting member is arranged at the lower portion of the air duct assembly 2, where the movable limiting member is configured to movably protrude from the air duct assembly and engage with the limiting structure. It can be understood that, compared with the prior art that the lower portion of the air duct assembly 2 is fixed with screws, this arrangement simplifies the disassembly process of the air duct assembly 2, thereby effectively improving the convenience of maintenance or cleaning of the air duct assembly 2.

Further, the movable limiting member is pivotally connected to the lower portion of the air duct assembly 2 in the left-right direction to rotate back and forth relative to the air duct assembly 2. It can be understood that with such a setting, the limiting and opening of the movable limiting member may be achieved through a simple rotating action, and the operation is convenient and fast, which improves the convenience for the user to unlock or fix the lower portion of the air duct assembly 2. It should be noted that the disclosure is not limited to this. In other embodiments, the movable limiting member may also be slidably connected to the lower portion of the air duct assembly 2 in the front-rear direction to slide back and forth relative to the air duct assembly 2.

Further, referring to FIG. 7 and FIGS. 10-12, the movable limiting member may be a first rotating buckle 3. The first rotating buckle 3 includes a first buckle body 31, which is pivotally connected to the lower portion of the air duct assembly 2 in the left-right direction. The first rotating buckle 3 further includes a first buckle portion 32, which is located at an end of the first buckle body 31 adjacent to the chassis 1. The limiting structure is a buckle slot 11 adapted to fit the first buckle portion 32. It can be understood that with such a setting, the lower portion of the air duct assembly 2 and the chassis 1 may be fixed through the first buckle portion 32 being buckled (or snap-fitted) and matched with the buckle slot 11, and the structure is simple and the connection is stable. It should be noted that the disclosure is not limited to this. In other embodiments, the buckle slot 11 may be defined on an end of the first buckle body 31 adjacent to the chassis 1, and the limiting structure may be a structure similar to the first buckle portion 32 adapted to fit the buckle slot 11. In the shown embodiment, at least two buckle slots 11 are arranged at the lower portion of the chassis 1 in the left-right direction. Correspondingly, at least two first rotating buckles 3 are provided at the lower portion of the air duct assembly 2 to better ensure the fixing stability of the lower portion of the air duct assembly 2.

Further, the lower portion of the air duct assembly 2 includes: a first mounting slot 21, which penetrates through a wall of the air duct assembly 2 in a front-rear direction. The first rotating buckle 3 is partially provided in the first mounting slot 21, and a side wall of the first mounting slot 21 includes a first shaft hole 211 in the left-right direction. The first buckle body includes a first rotating shaft 33, which is in clearance fit with the first shaft hole 211 and inserted in the first shaft hole 211. It can be understood that with such a setting, on the one hand, it can effectively protect the first rotating buckle 3 and avoid external structures from interfering with the normal operation of the first rotating buckle 3. On the other hand, the manner in which the shaft hole cooperates with the rotating shaft to implement the pivot connection achieves the advantages of simple structure and stable connection. In this embodiment, the first buckle body 31 is of a convex arc-shape and faces upwardly, and one first rotating shaft 33 is respectively provided to both sides of the apex of the convex arc. Correspondingly, one first shaft hole 211 corresponding to each first rotating shaft 33 is respectively provided to two side walls of the first mounting slot 21. A pressing portion for the user to press is defined at an end of the first buckle body 31 facing away from the chassis 1. It should be noted that the disclosure is not limited to this. In other embodiments, the first buckle body 31 may also be set in other shapes.

Further, the first mounting slot 21 includes two side walls, and each side wall includes a guiding slot 213 extending rearward and obliquely from a front edge of the each side wall, and a tail end of each guiding slot 213 includes one first shaft hole 211. It can be understood that with such a setting, the guiding slot 213 may guide the first rotating buckle 3 to be assembled into or disassembled from the first mounting slot 21, thereby improving the convenience of replacing or repairing the first rotating buckle 3.

Further, an elastic protrusion 212 protrudes downwardly from a top wall of the first mounting slot 21. An abutting rib 34 protrudes from an upper surface of the first buckle body 31, and the abutting rib 34 includes: a first limiting slot 341, which is recessed on the abutting rib 34 and faces the elastic protrusion 212; and a second limiting slot 342, which is recessed on the abutting rib 34 and faces the elastic protrusion 212. The first limiting slot 341 is located in front of the second limiting slot 342. The elastic protrusion 212 movably abut against the abutting rib 34. The elastic protrusion 212 is limited by the first limiting slot 341 to keep the first buckle portion 32 being engaged with the buckling slot 11. The elastic protrusion 212 is limited by the second limiting slot 342 to keep the first buckle portion 32 being away from the buckle slot 11. It can be understood that with such a setting, the limit is kept by the elastic protrusion 212 and the two limiting slots, and the first rotating shaft 33 is in clearance fit with the second shaft hole 411, so that the user may more easily rotate the first rotating buckle 3. In this embodiment, a first protrusion portion 343 protrudes from an upper side of the abutting rib 34, and a second protrusion portion 344 also protrudes from the upper side of the abutting rib 34. The first protrusion portion 343 and the second protrusion portion 344 are spaced apart in the front-rear direction, and the first protrusion portion 343 is located in front of the second protrusion portion 344. The first limiting slot 341 is defined between the first protrusion portion 343 and the second protrusion portion 344, and the second limiting slot 342 is defined at a rear side of the second protrusion portion 344. It can be understood that with such a setting, the structures of the first limiting slot 341 and the second limiting slot 342 may be easily and conveniently implemented. In addition, in this embodiment, the top wall of the first mounting slot 21 extends rearwardly to define an extending portion, and a bottom of the extending portion is provided with the elastic protrusion 212. The elastic protrusion 212 and the abutting rib 34 are in convex arc-shaped to each other. Certainly, in other embodiments, different states of the first buckle portion 32 may be maintained by the friction limit between the first rotating shaft 33 and the first shaft hole 211, which does not limit the scope of the disclosure.

Further, referring to FIG. 8, FIG. 9, and FIGS. 13-15, a bottom of a front water receiving tray 22 of the air duct assembly 2 includes: an engaging portion 221. The surface frame 4 includes: a second rotating buckle 5, which is adapted to fit the engaging portion 221, and pivotally connected to the face frame 4 in the left-right direction to rotatably engage with the engaging portion 221. It can be understood that with such a setting, the front portion of the air duct assembly 2 may be effectively limited and protected, so that the air duct assembly 2 may be prevented from being exposed from the inner cavity of the indoor unit of the air conditioner when the front portion is exposed to excessive downward force. In addition, the rotatable engaging method is convenient for the user to operate, and is beneficial to improving the convenience of the user in disassembling and assembling the air duct assembly 2. It should be noted that the disclosure is not limited to this. In another embodiment, the engaging portion 221 may be provided at the front side of the face frame 4, and the second rotating buckle 5 adapted to fit the engaging portion 221 may be provided to the front water receiving tray 22. The second rotating buckle 5 may be pivotally connected to the bottom of the front water receiving tray 22 in the left-right direction to be rotatably engaged with the engaging portion 221. Certainly, in other embodiments, the front portion of the air duct assembly 2 may be connected to the face frame 4 through other methods.

Further, the second rotating buckle 5 includes: a second buckle body 51, and one end of the second buckle body 51 is pivotally connected to the face frame 4 in the left-right direction; and a second buckle portion 52, which is located on a surface of the second buckle body 51 facing the air duct assembly 2, and disposed away from a pivot end of the second buckle body 51. In this embodiment, the second buckle portion 52 is a buckle block protruding from the surface of the second buckle body 51, and the engaging portion 221 is an engaging block protruding from the bottom of the front water receiving tray 22. The buckle block and the engaging block both have an inclined surface adapted to each other. Certainly, the disclosure is not limited to this. In other embodiments, the second buckle portion 52 may be a buckle block protruding from the surface of the second buckle body 51, and the engaging portion 221 may also be an engaging slot recessed at the bottom of the front water receiving tray 22 and adapted to fit the buckle block.

Further, the face frame 4 includes: a second mounting slot 41, which penetrates through a wall of the face frame 4 in the front-rear direction. A side wall of the second mounting slot 41 includes a second shaft hole 411 in the left-right direction. The second buckle body includes a second rotating shaft 53, which is in clearance fit with the second shaft hole 411 and is inserted in the second shaft hole 411. It can be understood that with such a setting, on the one hand, it can effectively protect the second rotating buckle 5 and avoid external structures from interfering with the normal operation of the second rotating buckle 5. On the other hand, the manner in which the shaft hole cooperates with the rotating shaft to implement the pivot connection achieves the advantages of simple structure and stable connection. In this embodiment, an abutting block 54 is further provided on a surface of the second buckle body 51 facing the front water receiving tray 22. The abutting block 54 is located between the second buckle portion 52 and the second rotating shaft 53 in the up-down direction, so that when the second buckle portion 52 is buckled (or snap-fitted) to the engaging portion 221, the abutting block 54 may abut against a front surface of the front water receiving tray 22 to improve the structural strength of the second buckling body 51 at the position. In addition, in this embodiment, two limiting protrusions 412 are disposed oppositely with each other, and each limiting protrusion 412 protrudes from an edge at a side of a slot opening of the second mounting slot 41. The two second limiting protrusions 412 are located in front of the second buckle body 51 when the second buckle portion 52 is buckled (or snap-fitted) with the engaging portion 221, so that the second rotating buckle 5 may be prevented from easily being rotated out of the second mounting slot 41 under the action of an external force. It should be noted that the disclosure is not limited to this. In other embodiments, the second mounting slot 41 may be provided with other limiting structures to prevent the second rotating buckle 5 from being rotated out of engagement easily.

Figure 4:
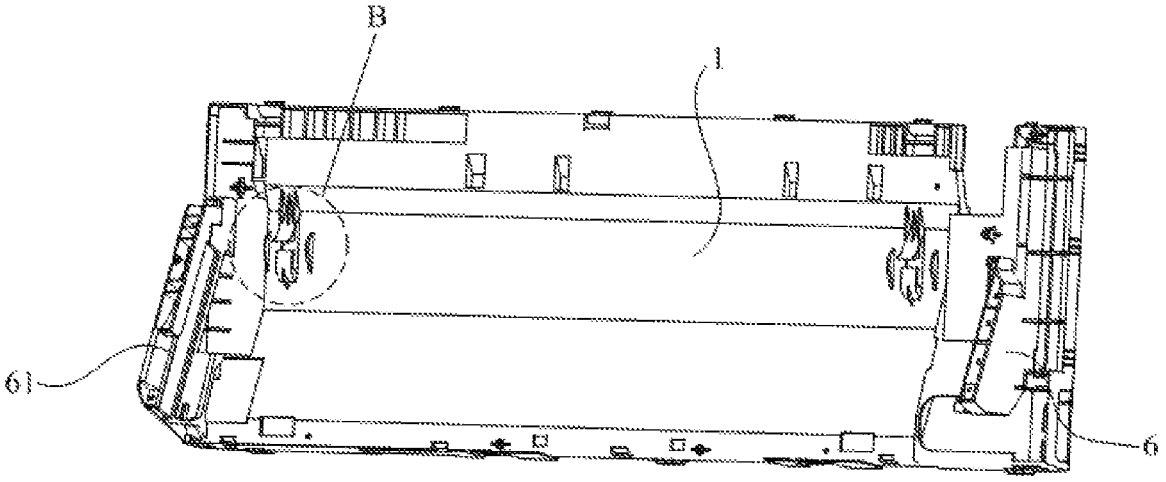
FIG. 4 is a schematic structural view of a bracket in FIG. 2.
Figure 5:
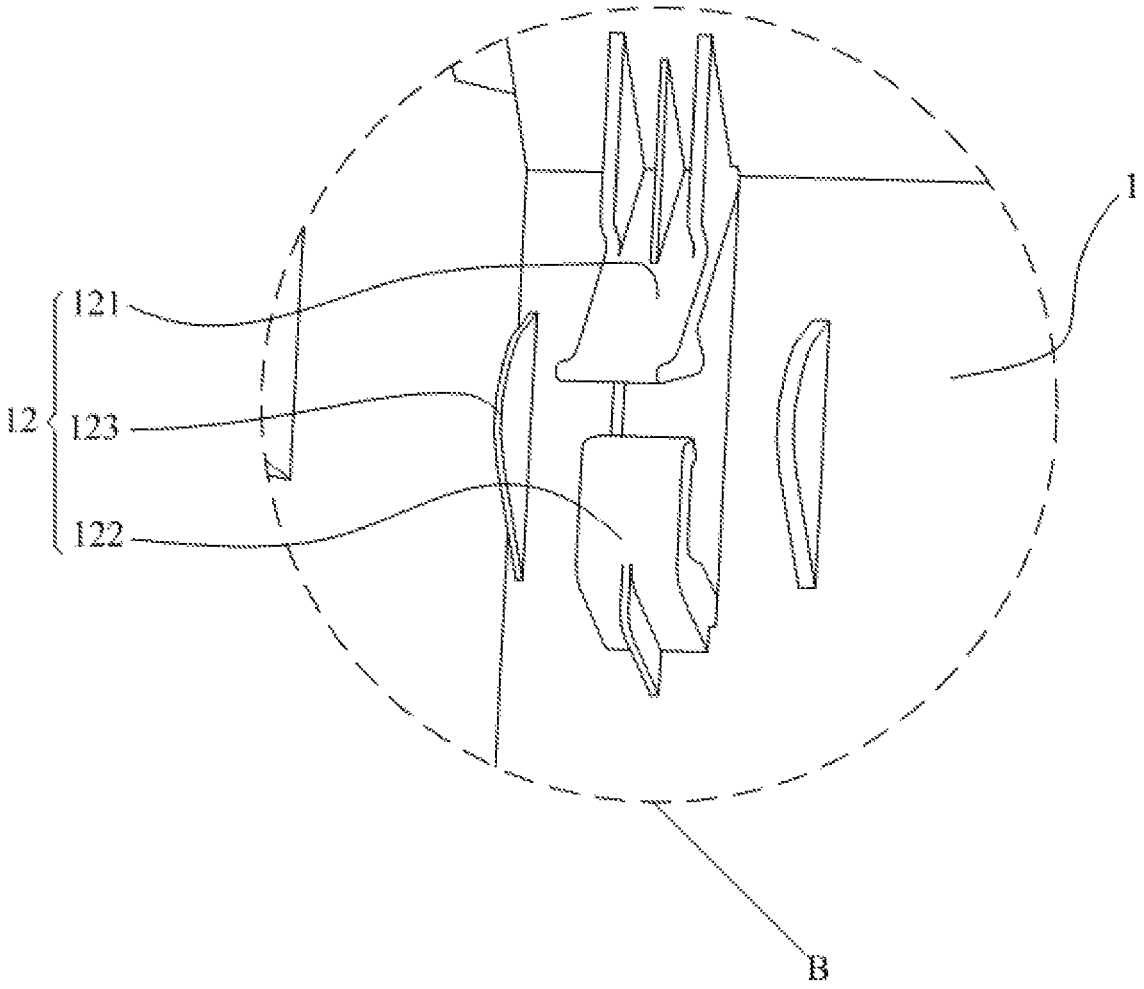
FIG. 5 is a schematic enlarged view of a portion B in FIG. 4.
Figure 6:
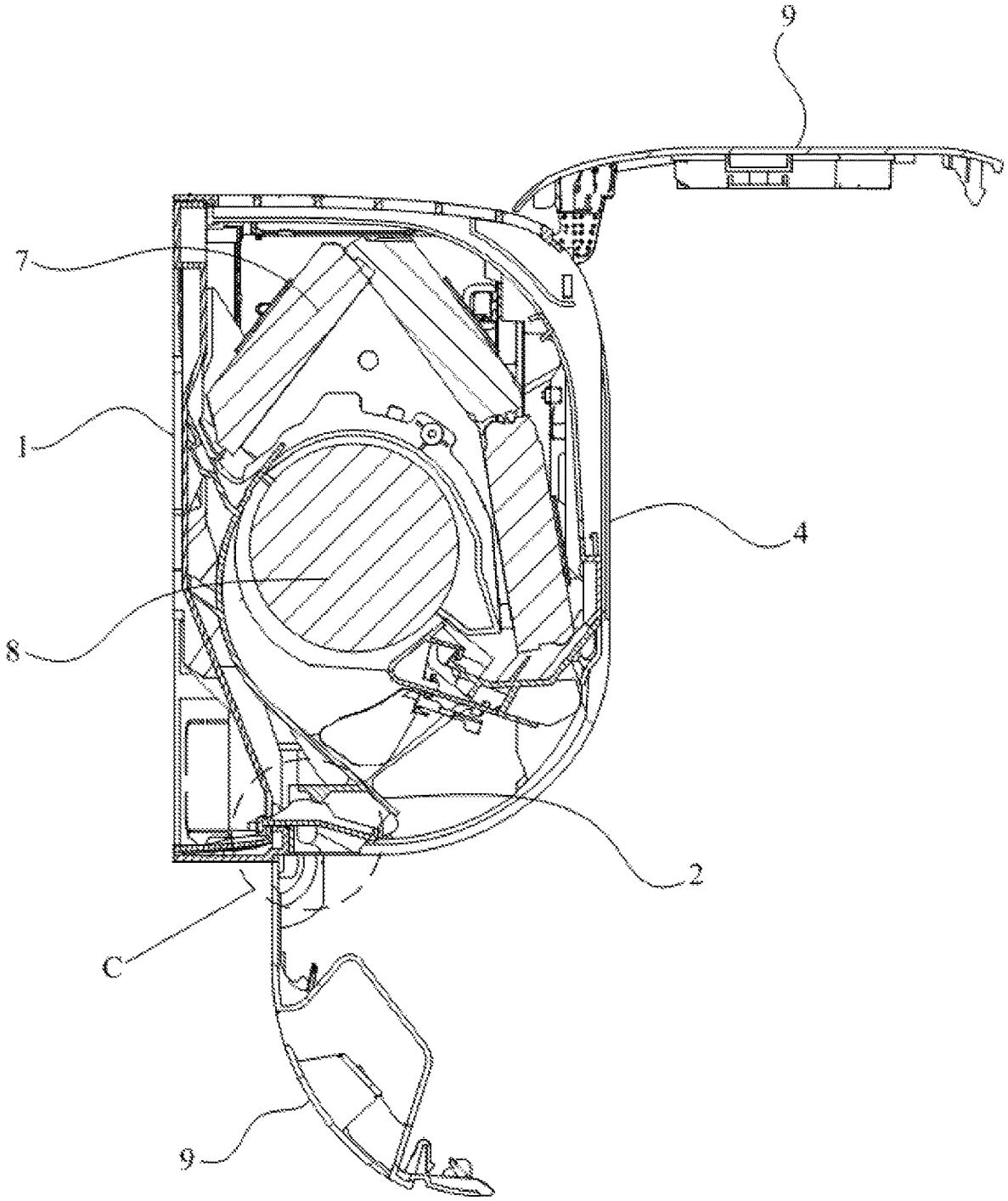
FIG. 6 is another schematic cross-sectional view of the indoor unit of the air conditioner in FIG. 1.
Figure 7:
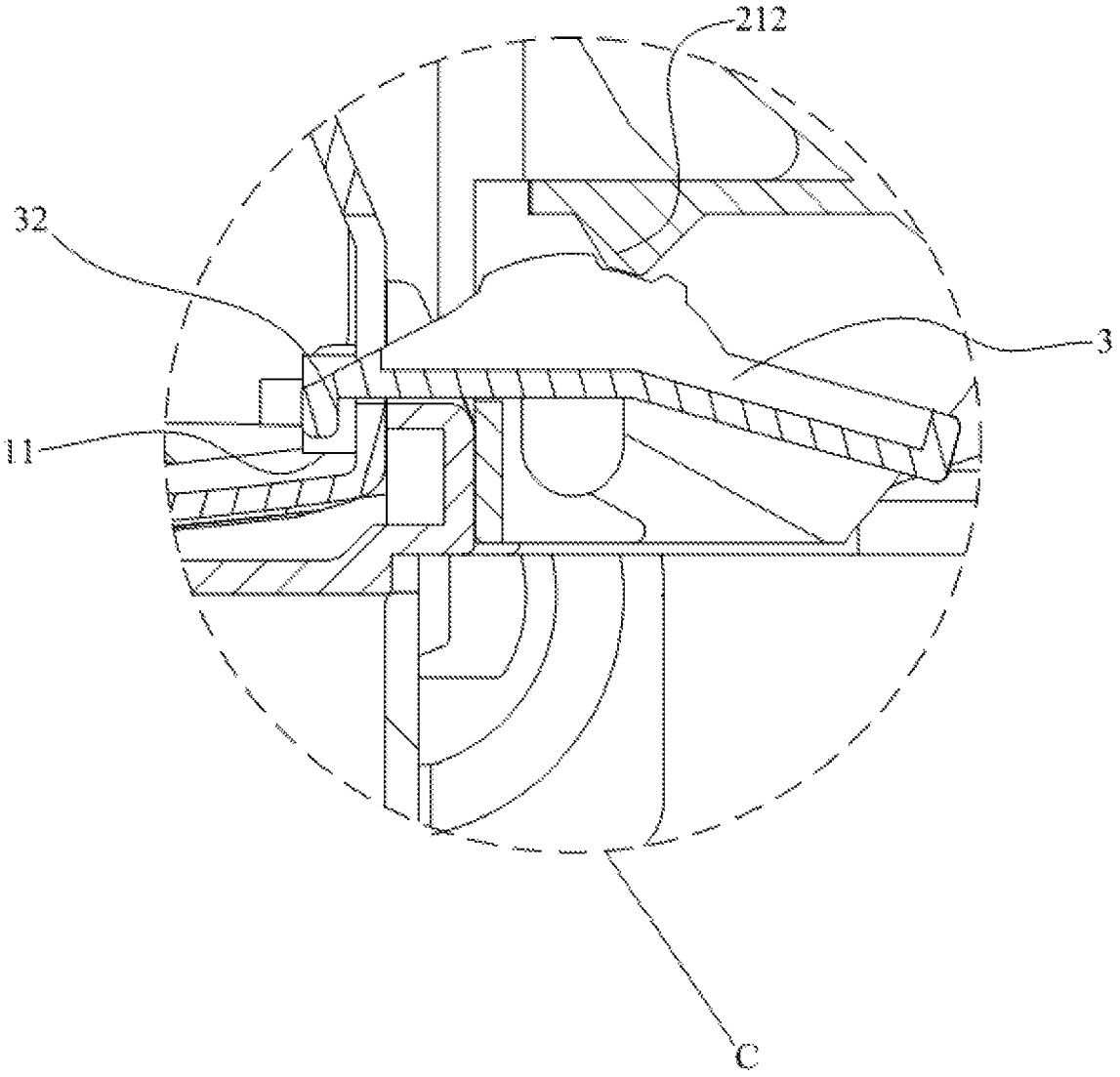
FIG. 7 is a schematic enlarged view of a portion C in FIG. 6.
Figure 8:
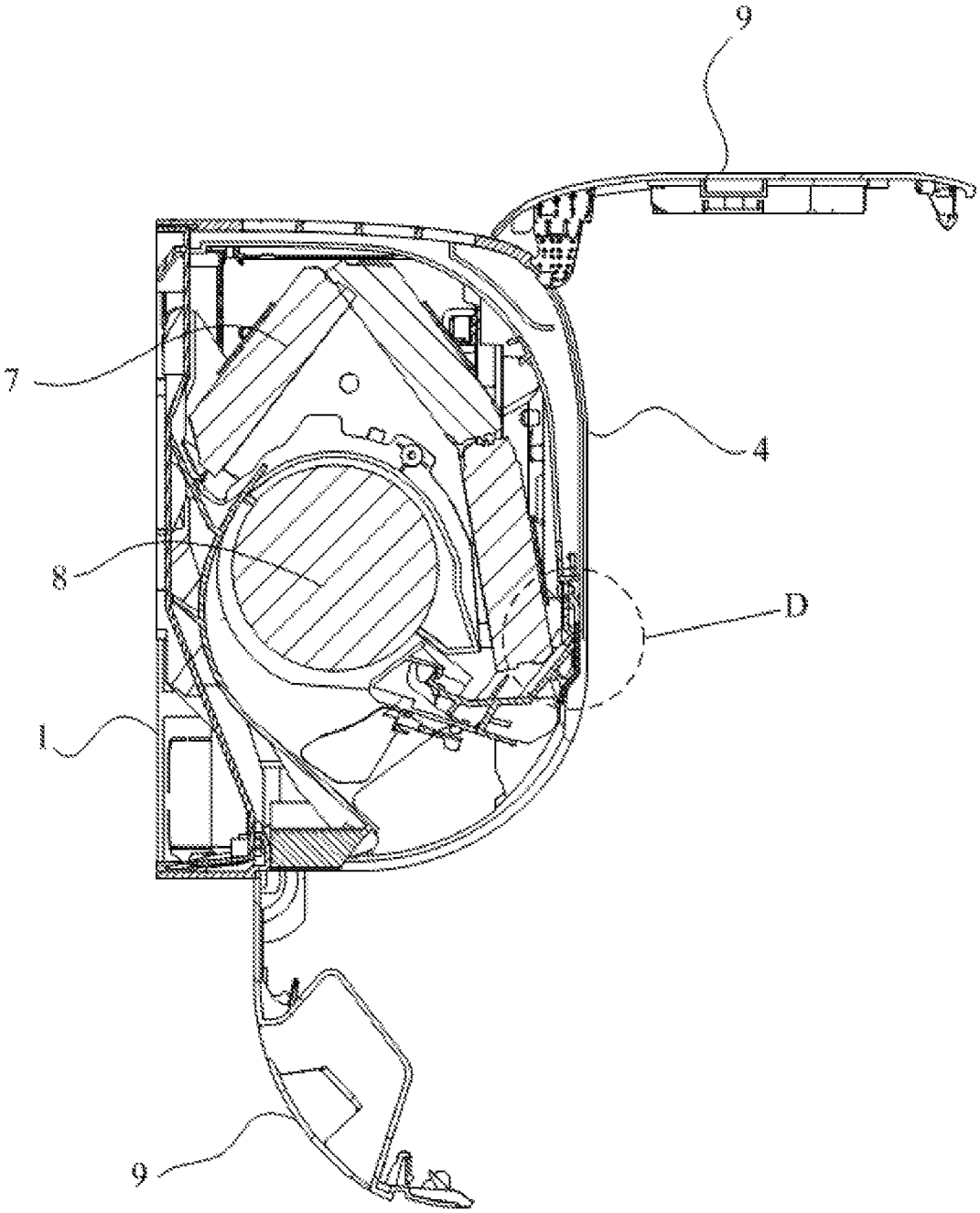
FIG. 8 is still another schematic cross-sectional view of the indoor unit of the air conditioner in FIG. 1.
Figure 9:
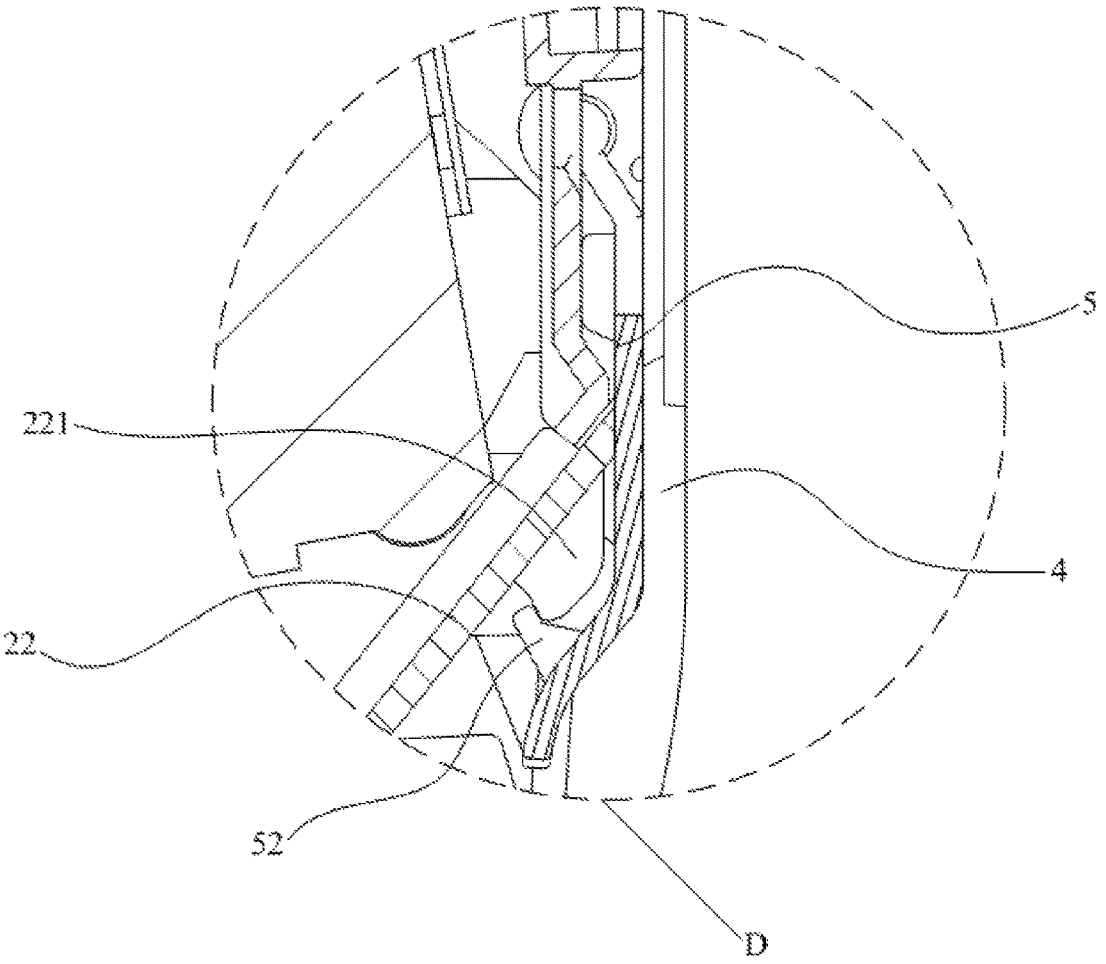
FIG. 9 is a schematic enlarged view of a portion D in FIG. 8.

Further, referring to FIGS. 4 and 5, elastic engaging buckles 12 are provided at an upper portion of the chassis 1 in the left-right direction. Engaging structures are provided at a rear edge of a rear water receiving tray 23 of the air duct assembly 2 in the left-right direction. The elastic engaging buckles 12 are detachably engaged with the engaging structures. In this embodiment, the elastic buckle 12 includes an upper elastic buckle 121 and a lower elastic buckle 122 which are spaced in parallel and extend toward the front lower side. The elastic buckle 12 further includes guide blocks 123, which are respectively disposed on both sides of the upper elastic buckle 121 and the lower elastic buckle 122. The engaging structure is an engaging slot 231 adapted to be inserted into a gap between the upper elastic buckle 121 and the lower elastic buckle 122. A bottom end of the upper elastic buckle 121 abuts against an inner wall of the engaging slot 231, and a top end of the lower elastic buckle 122 abuts against an outer wall of the engaging slot 231. The two guiding blocks 123 are configured to guide the engaging slot 231 to be inserted into the gap between the upper elastic buckle 121 and the lower elastic buckle 122. It can be understood that with such a setting, it can be ensured that the air duct assembly 2 is easy to disassemble, thereby reducing the production cost of the chassis 1. It should be noted that the disclosure is not limited to this, and other engaging structures may be provided between the chassis 1 and the upper portion of the air duct assembly 2; alternatively, the chassis 1 and the upper portion of the air duct assembly 2 may be connected by magnetic attraction.

Figure 10:
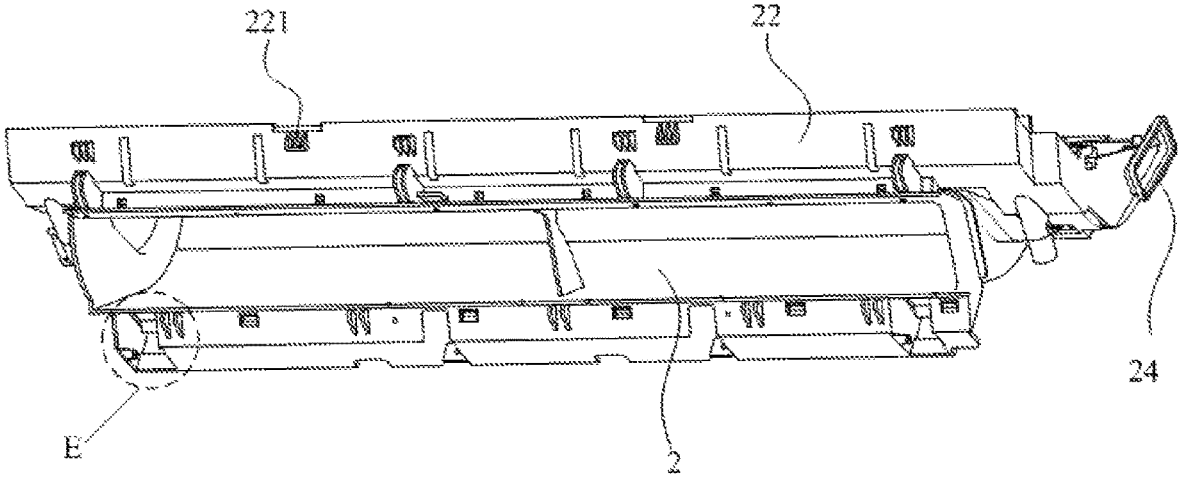
FIG. 10 is a schematic structural view of an air duct assembly in FIG. 2.
Figure 11:
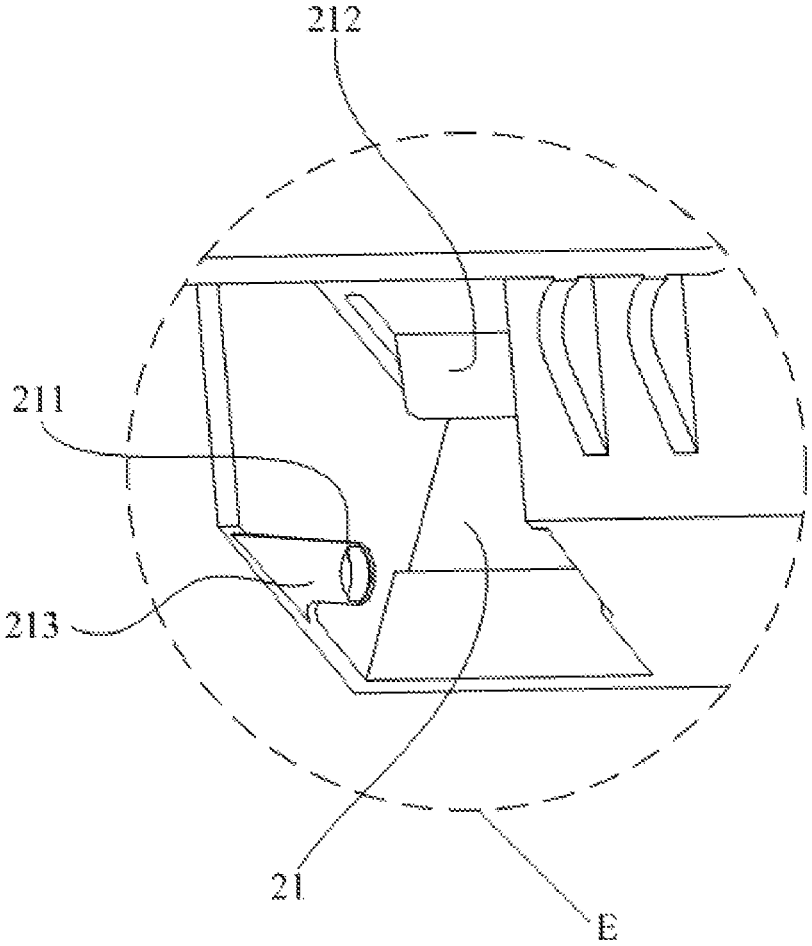
FIG. 11 is a schematic enlarged view of a portion E in FIG. 10.
Figure 12:
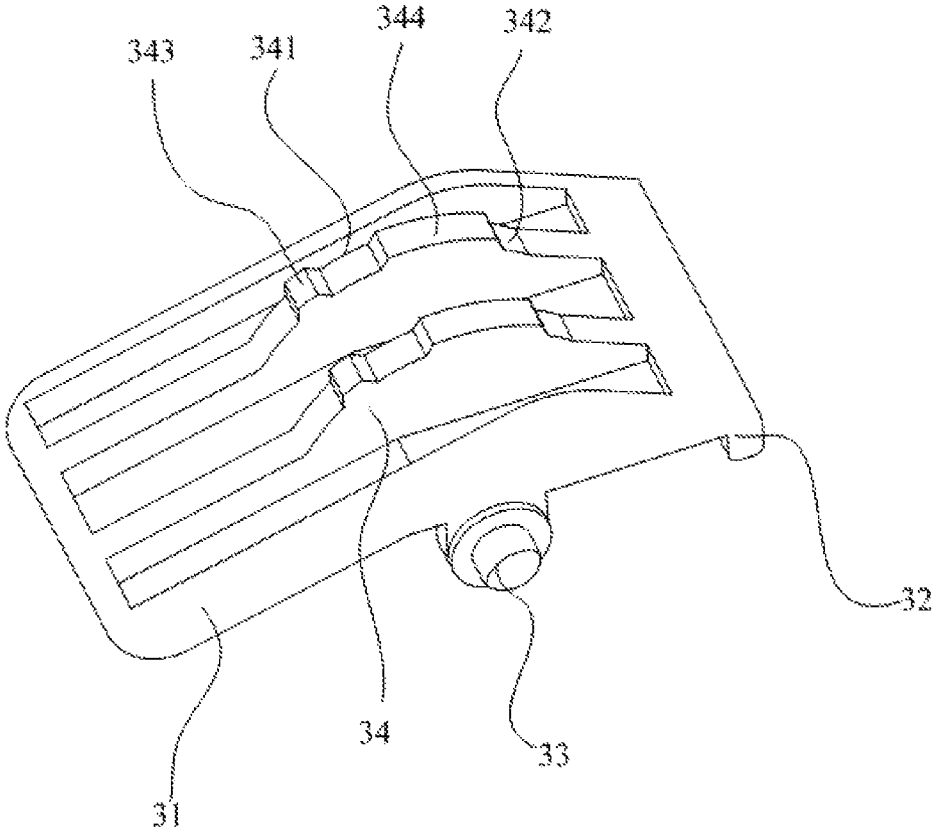
FIG. 12 is a schematic structural view of a first rotating buckle in FIG. 7.
Figure 13:
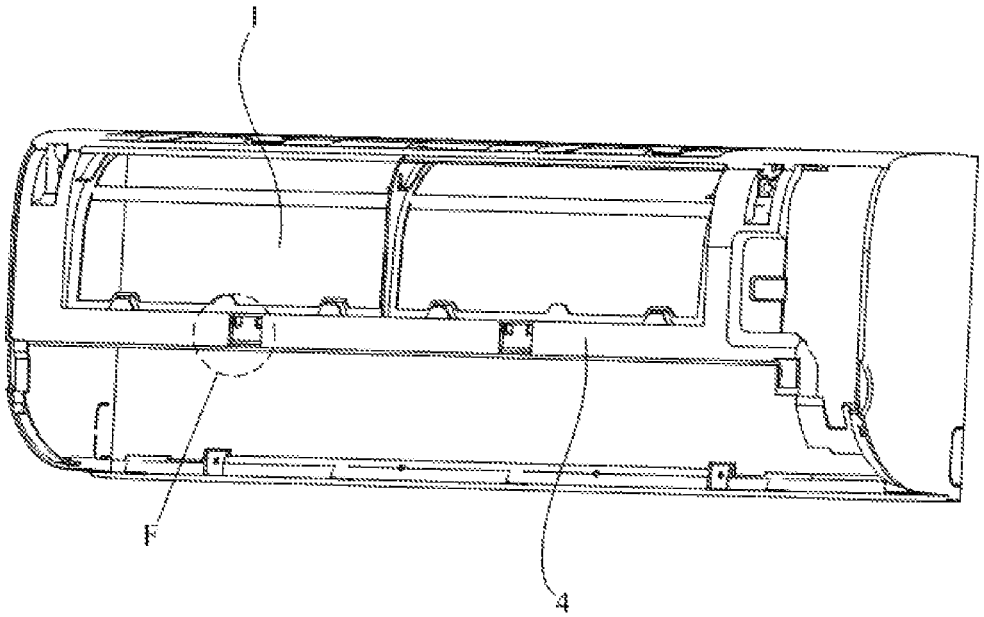
FIG. 13 is a schematic structural view of a face frame in FIG. 2.
Figure 14:
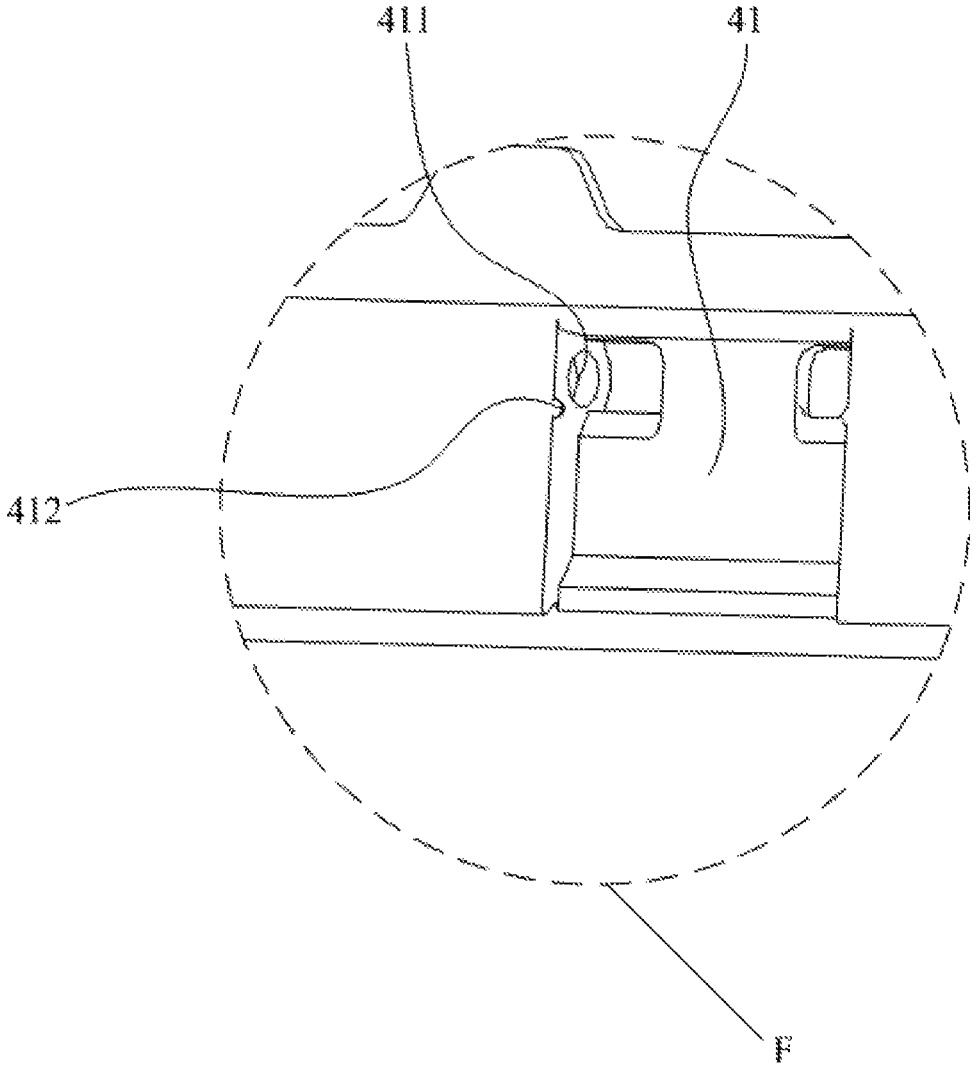
FIG. 14 is a schematic enlarged view of a portion F in FIG. 13.
Figure 15:
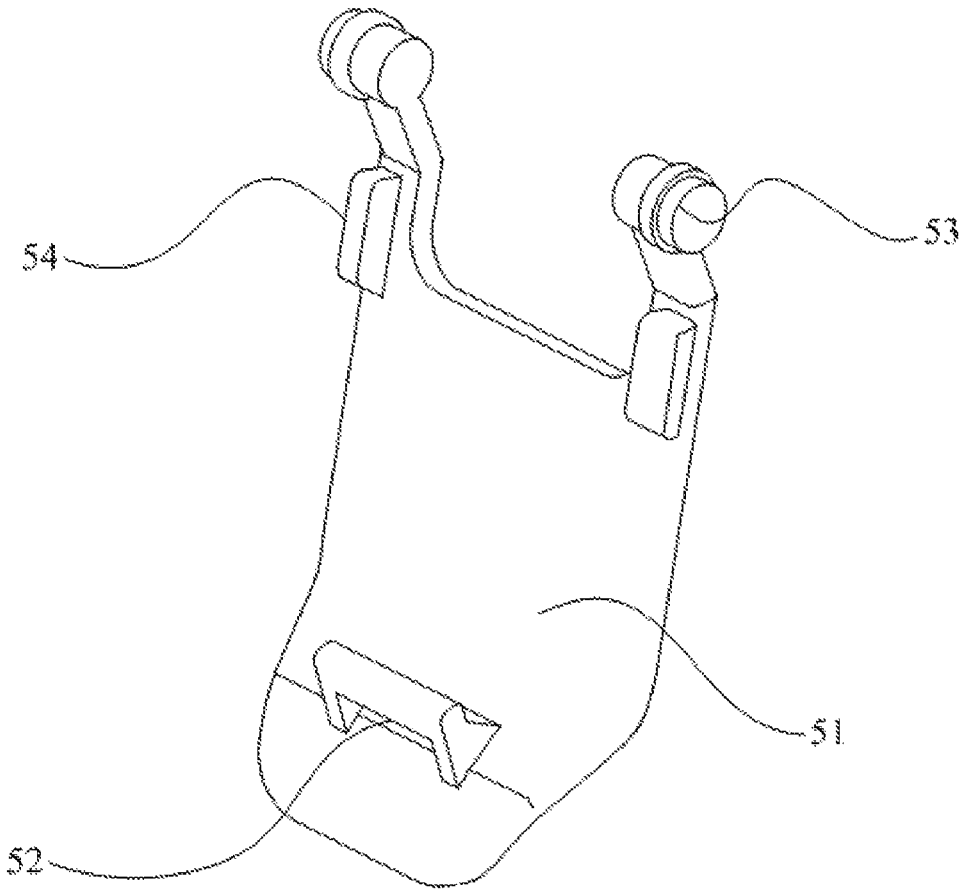
FIG. 15 is a schematic structural view of a second rotating buckle in FIG. 9.

Further, referring to FIG. 4 and FIG. 10, the bracket further includes two fixing portions 6. One fixing portion 6 protrudes from a left end of a front side of the chassis 1, and the other fixing portion 6 protrudes from a right end of the front side of the chassis 1. Each fixing portion 6 includes a first sliding portion, which is provided on an opposite lateral side of each fixing portion 6. The air duct assembly 2 includes two second sliding portions. One second sliding portion is provided on a left end of the air duct assembly 2, and the other second sliding portion is provided on a right end of the air duct assembly 2. Each first sliding portion and each corresponding second sliding portion are slidably matched in a up-down direction of the chassis 1. In this embodiment, the first sliding portion is a guiding rail 61 extending obliquely from an upper side of the fixing portion 6 toward the front lower side, and the second sliding portion is a sliding shaft 24 slidingly adapted to the guiding rail 61, so that the air duct assembly 2 may be slidingly pushed in or pulled out relative to the inner cavity of the indoor unit of the air conditioner, thereby improving the convenience for users to repair or clean the air duct assembly 2. In other embodiments, the second sliding portion may also be a guiding rail 61 extending obliquely from the upper portion of the air duct assembly 2 toward the front lower side, and the first sliding portion may be a sliding shaft 24 slidingly adapted to the guiding rail 61, which does not limit the scope of the disclosure.

The present disclosure further provides an air conditioner, which includes an outdoor unit and an indoor unit. Specific structure of the indoor unit of the air conditioner may refer to the foregoing embodiments. Since the air conditioner adopts all the technical solutions of all the above embodiments, it at least has all the beneficial effects brought by the technical solutions of the foregoing embodiments, which are not described in detail here again.

The above is only preferred embodiments of the present disclosure, and thus does not limit the scope of the present disclosure, and the equivalent structural transformation made by the content of the specification and the drawings of the present disclosure, or directly/indirectly applied to other related technical fields are all included in the patent protection scope of the present disclosure.

What is claimed is:

1. An indoor unit of an air conditioner, comprising:

a bracket, wherein the air conditioner comprises a rear side defined by the bracket and a front side distanced from and opposite to the rear side, wherein the air conditioner is mountable to a support through the rear side, the bracket comprising:

a chassis comprising:

a limiting structure;

an air duct assembly, located in front of the chassis and detachably connected with the chassis; and a movable limiting member provided to the air duct assembly, wherein the movable limiting member is configured to movably protrude from the air duct assembly and engage with the limiting structure to limit the air duct assembly inside the bracket, wherein the movable limiting member is pivotally connected to a lower portion of the air duct assembly in a left-right direction to rotate forwardly and rearwardly with respect to the air duct assembly, wherein the movable limiting member comprises a first rotating buckle, the first rotating buckle comprising:

a first buckle body, pivotally connected to the lower portion of the air duct assembly in the left-right direction; and a first buckle portion, located at an end of the first buckle body adjacent to the chassis;

wherein the limiting structure comprises a buckle slot adapted to fit the first buckle portion, wherein the lower portion of the air duct assembly comprises:

a first mounting slot, penetrating through a wall of the air duct assembly in a front-rear direction, the first rotating buckle being partially provided in the first mounting slot, a side wall of the first mounting slot comprising a first shaft hole in the left-right direction; and wherein the first buckle body comprises a first rotating shaft, matched with the first shaft hole and inserted in the first shaft hole.

2. The indoor unit of the air conditioner according to claim 1, wherein the first mounting slot comprises two side walls, each side wall comprising a guiding slot extending rearwardly and obliquely from a front edge of the each side wall, a tail end of each guiding slot comprising one first shaft hole.

3. The indoor unit of the air conditioner according to claim 1, further comprising:

an elastic protrusion protruding downwardly from a top wall of the first mounting slot; and an abutting rib, protruding from an upper surface of the first buckle body and comprising:

a first limiting slot, recessed on the abutting rib and facing the elastic protrusion;

a second limiting slot, recessed on the abutting rib and facing the elastic protrusion; and wherein the first limiting slot is located in front of the second limiting slot;

wherein:

the elastic protrusion movably abut against the abutting rib;

the elastic protrusion is limited by the first limiting slot to keep the first buckle portion being engaged with the buckle slot; and the elastic protrusion is limited by the second limiting slot to keep the first buckle portion being away from the buckle slot.

4. The indoor unit of the air conditioner according to claim 3, further comprising:

a first protrusion portion protruding from an upper side of the abutting rib; and a second protrusion portion protruding from the upper side of the abutting rib;

wherein:

the first protrusion portion and the second protrusion portion are spaced apart in the front-rear direction, the first protrusion portion being located in front of the second protrusion portion; and the first limiting slot is defined between the first protrusion portion and the second protrusion portion, the second limiting slot being defined at a rear side of the second protrusion portion.

5. The indoor unit of the air conditioner according to claim 1, wherein the bracket further comprises:

a face frame, located in front of the air duct assembly, a front side of the air duct assembly being movably engaged with the face frame.

6. The indoor unit of the air conditioner according to claim 5, wherein:

a bottom of a water receiving tray in front of the air duct assembly comprises an engaging portion; and the face frame comprises a second rotating buckle, adapted to fit the engaging portion and pivotally connected to the face frame in the left-right direction to rotatably engage with the engaging portion.

7. The indoor unit of the air conditioner according to claim 6, wherein the second rotating buckle comprises:

a second buckle body, one end of the second buckle body being pivotally connected to the face frame in the left-right direction; and a second buckle portion, located on a surface of the second buckle body facing the air duct assembly, and disposed away from a pivot end of the second buckle body.

8. The indoor unit of the air conditioner according to claim 7, wherein:

the face frame comprises a second mounting slot, penetrating through a wall of the face frame in the front-rear direction, a side wall of the second mounting slot comprising a second shaft hole in the left-right direction; and the second buckle body comprises a second rotating shaft, matched with the second shaft hole, and inserted in the second shaft hole.

9. The indoor unit of the air conditioner according to claim 8, further comprising:

two limiting protrusions, disposed oppositely with each other, each limiting protrusion protruding from an edge at a side of a slot opening of the second mounting slot; and wherein the two second limiting protrusions are located in front of the second buckle body when the second buckle portion is buckled or snap-fitted with the engaging portion.

10. The indoor unit of the air conditioner according to claim 1, further comprising:

elastic engaging buckles, provided at an upper portion of the chassis in the left-right direction; and engaging structures, provided at a rear edge of an upper portion of the air duct assembly in the left-right direction;

wherein the elastic engaging buckles are detachably engaged with the engaging structures.

11. The indoor unit of the air conditioner according to claim 1, wherein:

the bracket further comprises:

two fixing portions, one fixing portion protruding from a left end of a front side of the chassis, the other fixing portion protruding from a right end of the front side of the chassis, each fixing portion comprising:

a first sliding portion, provided on an opposite lateral side of each fixing portion a lateral side of said each fixing portion facing another fixing portion; and the air duct assembly comprises:

two second sliding portions, one second sliding portion being provided on a left end of the air duct assembly, the other second sliding portion being provided on a right end of the air duct assembly; and wherein each first sliding portion and each corresponding second sliding portion are slidably matched in an up-down direction of the chassis.

12. An air conditioner, comprising:

an outdoor unit; and an indoor unit comprising:

a bracket, wherein the air conditioner comprises a rear side defined by the bracket and a front side distanced from and opposite to the rear side, wherein the air conditioner is mountable to a support through the rear side, the bracket comprising:

a chassis comprising a limiting structure;

an air duct assembly, located in front of the chassis, and detachably engaged or magnetically connected with the chassis; and a movable limiting member, provided to the air duct assembly, wherein the movable limiting member is configured to movably protrude from the air duct assembly and engage with the limiting structure to limit the air duct assembly inside the bracket, wherein the movable limiting member is pivotally connected to a lower portion of the air duct assembly in a left-right direction to rotate forwardly and rearwardly with respect to the air duct assembly, wherein:

the movable limiting member comprises a first rotating buckle, the first rotating buckle comprising:

a first buckle body, pivotally connected to the lower portion of the air duct assembly in the left-right direction; and a first buckle portion, located at an end of the first buckle body adjacent to the chassis; and the limiting structure comprises a buckle slot adapted to fit the first buckle portion, and wherein:

the lower portion of the air duct assembly comprises:

a first mounting slot, penetrating through a wall of the air duct assembly in a front-rear direction, the first rotating buckle being partially provided in the first mounting slot, a side wall of the first mounting slot comprising a first shaft hole in the left-right direction; and the first buckle body comprises:

a first rotating shaft, matched with the first shaft hole and inserted in the first shaft hole.

13. The air conditioner according to claim 12, wherein the bracket further comprises:

a face frame, located in front of the air duct assembly, a front side of the air duct assembly being movably engaged with the face frame.

14. The air conditioner according to claim 13, wherein:

a bottom of a water receiving tray in front of the air duct assembly comprises an engaging portion; and the face frame comprises a second rotating buckle, adapted to fit the engaging portion and pivotally connected to the face frame in the left-right direction to rotatably engage with the engaging portion.

* * * * *